US008240076B2

(12) United States Patent
Carley

(10) Patent No.: US 8,240,076 B2
(45) Date of Patent: Aug. 14, 2012

(54) COVER FOR A TELESCOPIC SIGHT

(75) Inventor: Jason C. Carley, Dix Hills, NY (US)

(73) Assignee: Carson Optical, Inc., Hauppauge, NY (US)

( * ) Notice: Subject to any disclaimer, the term of this patent is extended or adjusted under 35 U.S.C. 154(b) by 649 days.

(21) Appl. No.: 12/189,824

(22) Filed: Aug. 12, 2008

(65) Prior Publication Data

US 2010/0037506 A1 Feb. 18, 2010

(51) Int. Cl.
*F41G 1/04* (2006.01)

(52) U.S. Cl. ..... 42/129; 206/317

(58) Field of Classification Search ..... 42/129, 42/96, 101; 206/316.1, 317; D22/108
See application file for complete search history.

(56) References Cited

U.S. PATENT DOCUMENTS

| | | | | | |
|---|---|---|---|---|---|
| 1,736,383 | A | | 11/1929 | Waggoner | |
| 2,364,340 | A | | 12/1944 | Bogg, Jr. | |
| 2,599,689 | A | * | 6/1952 | Brelsford | 42/96 |
| 2,657,465 | A | * | 11/1953 | Lloyd | 42/129 |
| 2,782,510 | A | * | 2/1957 | Kramm | 42/129 |
| 2,932,334 | A | | 4/1960 | Steen | |
| 3,208,146 | A | * | 9/1965 | Nelson | 42/129 |
| 3,496,642 | A | * | 2/1970 | Pfahler | 42/129 |
| 3,746,423 | A | * | 7/1973 | Mills | 359/511 |
| 3,831,285 | A | * | 8/1974 | Vissing | 42/129 |
| 3,977,113 | A | * | 8/1976 | Howell | 42/129 |
| 4,348,829 | A | | 9/1982 | Bosco et al. | |
| 4,394,797 | A | * | 7/1983 | Schuster | 42/143 |
| 4,398,367 | A | | 8/1983 | Gamble et al. | |
| D274,079 | S | * | 5/1984 | Schuster | D22/108 |
| 4,448,824 | A | | 5/1984 | Holmes | |
| 4,858,361 | A | | 8/1989 | White | |
| 4,860,479 | A | | 8/1989 | Easter | |
| 5,048,217 | A | | 9/1991 | Easter | |
| D323,372 | S | * | 1/1992 | Heckerman | D22/108 |
| 5,183,953 | A | | 2/1993 | Anderson et al. | |
| D348,356 | S | | 7/1994 | Nemoto | |
| 5,501,029 | A | | 3/1996 | McDaniel, Sr. | |
| 5,566,490 | A | * | 10/1996 | Owen | 42/90 |
| 5,642,585 | A | | 7/1997 | Watley | |
| 5,661,920 | A | | 9/1997 | Evans | |
| 5,678,344 | A | * | 10/1997 | Jones et al. | 42/96 |
| 5,850,706 | A | | 12/1998 | Evans | |
| D423,629 | S | * | 4/2000 | Granger | D22/108 |
| 6,119,388 | A | | 9/2000 | Jones et al. | |

(Continued)

OTHER PUBLICATIONS http://scopeshieldcover.com—How to Use.

*Primary Examiner* — Benjamin P Lee
(74) *Attorney, Agent, or Firm* — Carmody & Torrance LLP

(57) ABSTRACT

A covering device for an elongated telescopic sight that is mounted on a gun shaft, wherein the elongated telescopic sight has a first end and a second end, the covering device comprising a first pocket having an opening and a coverable end and a second pocket having an opening and a coverable end, wherein the first pocket is coupled to the second pocket by an intermediate member, oriented non-linearly relative to the second pocket, and is facing in at least a substantially opposite direction as the second pocket; wherein the first pocket is coverable upon the first end of the telescopic sight, the intermediate member is wrappable around, underneath or over at least a portion of the gun shaft and the second pocket is coverable upon the second end of the telescopic sight.

17 Claims, 7 Drawing Sheets

U.S. PATENT DOCUMENTS

| | | | | |
|---|---|---|---|---|
| 6,164,004 | A | 12/2000 | Essary | |
| D445,475 | S * | 7/2001 | Spear | D22/108 |
| 7,171,999 | B2 | 2/2007 | Cirone | |
| 7,559,168 | B2 * | 7/2009 | Wisecup et al. | 42/96 |
| D609,767 | S * | 2/2010 | Brewer | D22/108 |
| D622,808 | S * | 8/2010 | Obradovich | D22/199 |
| 2006/0191184 | A1 * | 8/2006 | Wisecup et al. | 42/96 |
| 2008/0110076 | A1 * | 5/2008 | Bennett et al. | 42/96 |

* cited by examiner

COVER FOR A TELESCOPIC SIGHT

BACKGROUND OF THE INVENTION

The present invention relates generally to covers for telescopic sights, and more particularly, to a cover constructed to more securely, efficiently and easily be mounted on and removed therefrom while also providing advantages heretofore not found in the prior art. Also provided herein are methods of using the cover of the present invention.

The prior art recognizes the desire of providing telescopic sight covers. However, such devices are generally more complicated, expensive to manufacture, difficult to use and/or lack the advantages and objectives sought out by those who use telescopic sights, for example but not limitation, in combination with guns on which such telescopic sights are mountable.

Thus, it is believed that further advances in the art are desirable. For example, covers for telescopic sights that are less complicated, easy to manufacture, easy to use and provides advantages over those devices in the prior art are desirable and advantageous. It is thus believed that the present invention overcomes the aforementioned deficiencies and achieves the aforementioned and below mentioned objectives.

SUMMARY AND OBJECTIVES OF THE PRESENT INVENTION

It is thus an objective of the present invention to overcome the perceived deficiencies in the prior art.

For example, it is objectives of the present invention to provide an improved cover device for a telescopic sight that is less complicated, less expensive to manufacture, easier to use, and just generally more desirable and versatile than prior art constructions.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

To overcome the perceived deficiencies in the prior art and to achieve the objects and advantages set forth above and below, the present invention is, generally speaking, directed to a covering device for an elongated telescopic sight having a first end and a second end.

In one preferred embodiment, the covering device comprises a first pocket having an opening and a coverable end and a second pocket having an opening and a coverable end, wherein the first pocket is:

a. coupled to the second pocket by an intermediate member,
b. oriented non-linearly relative to the second pocket, and
c. is facing in at least a substantially opposite direction as the second pocket;

wherein the first pocket is coverable upon the first end of the telescopic sight, the intermediate member is wrappable around, underneath or over at least a portion of the telescopic sight and the second pocket is coverable upon the second end of the telescopic sight.

In another preferred embodiment, where the elongated telescopic sight is mounted on a gun shaft, the covering device, the first pocket is coverable upon the first end of the telescopic sight, the intermediate member is wrappable around, underneath or over at least a portion of the gun shaft and the second pocket is coverable upon the second end of the telescopic sight.

In yet another preferred embodiment, a method of covering the ends of an elongated telescopic sight that is mounted on a gun shaft with the covering device of the present invention is provided. In a preferred embodiment, the method comprises the steps of covering the first end of the telescopic sight with the first pocket; wrapping the intermediate member around, underneath or over at least a portion of the gun shaft; and covering the second end of the telescopic sight with the second pocket.

In yet another preferred embodiment, the covering device comprises two opposing cover sections that fit over and around the ends of the telescopic sight, where the two sections are coupled by an intermediate member configured such that the two end sections are offset from each other and when wrapped around, underneath or over a portion of the gun shaft, the opposing cover sections are preferably held under tension. Yet further, a preferred embodiment provides that the two end sections are offset from each other and when wrapped around, underneath or over a portion of the telescopic sight, the opposing cover sections are preferably held under tension.

In yet another preferred embodiment, the covering device comprises a first pocket having an opening and a coverable end and a second pocket having an opening and a coverable end, wherein the first pocket is coupled to the second pocket by a intermediate arrangement; wherein the intermediate arrangement is dimensioned to permit the gun shaft to extend therethrough; wherein when the first pocket is coverable upon the first end of the telescopic sight and the second pocket is coverable upon the second end of the telescopic sight the gun shaft is intermediate the telescopic sight and at least a part of the intermediate arrangement.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
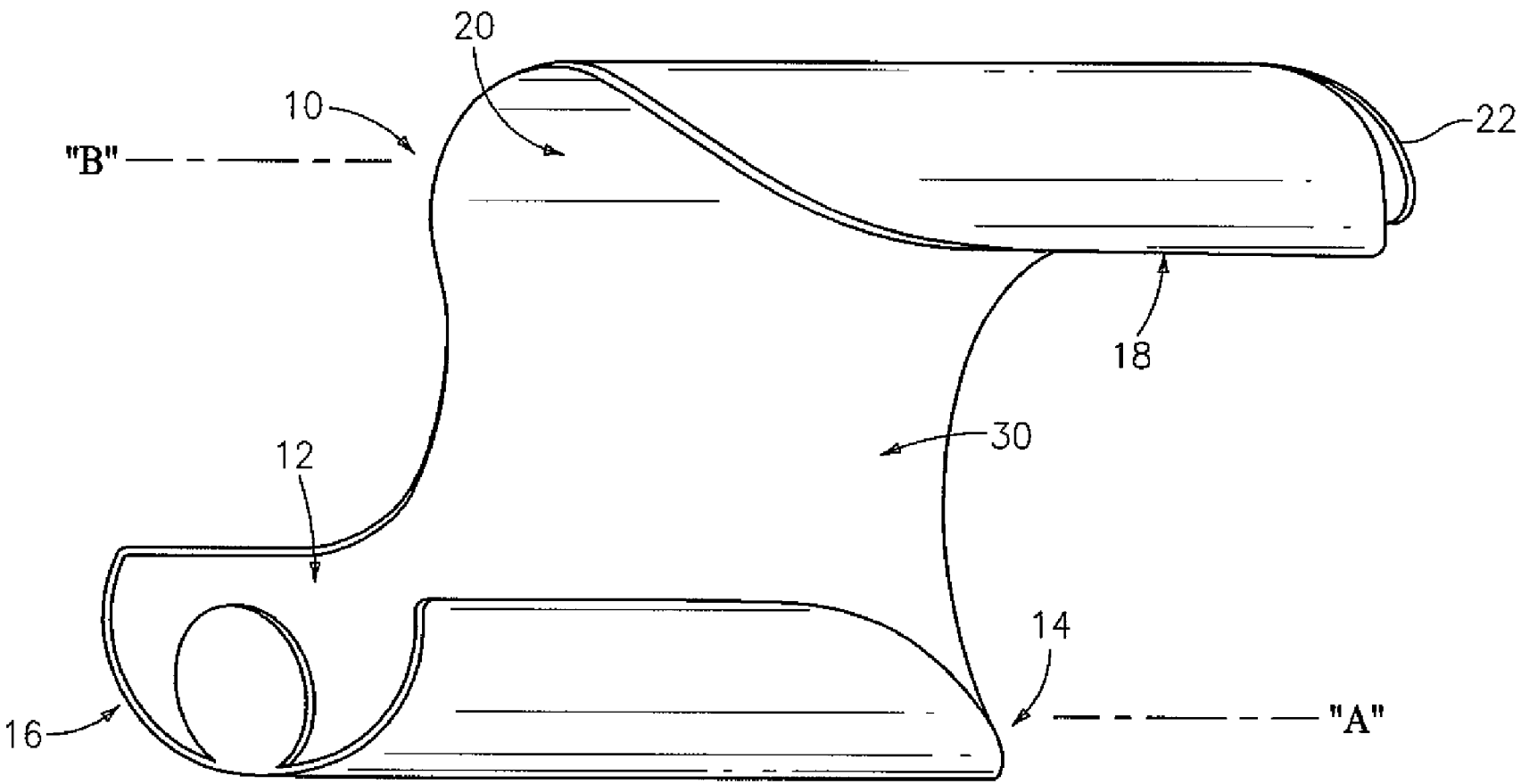
FIG. 1 is a perspective view of a covering device constructed in accordance with a first embodiment of the present invention.

Reference is now made to the Figures, which illustrate a covering device, generally indicated at 10, constructed in accordance with preferred embodiments of the present invention. Prior to discussing the specifics, however, general overviews, features and advantages thereof shall be discussed.

For example, in accordance with a first embodiment of the present invention, the covering device 10 is designed for a cylindrical element 100 and preferably a telescopic sight 100 having a first end 102 and a second end 104. In this preferred embodiment, covering device 10 comprises two opposing cover sections 12, 18 that fit over and around the ends of the cylindrical element (e.g. telescopic sight), where the two sections are coupled together (e.g. such as by way of example and not limitation, by being joined by a width of material) such that the two end sections are offset from each other, that when wrapped around, underneath or over a coaxial member, which in a preferred embodiment is a shaft of a gun 1000 on which the telescopic sight is mounted, the two opposing cover sections are preferably held under tension, and the telescopic sight is covered at least at its respective ends.

In a specific embodiment, the two cover sections and the central piece that couple them together are of a unitary piece of material (i.e. comprise a single unit) and thus would be of the same material, and may be a flexible cloth fabric and/or an elastic material such as neoprene, nylon or soft polymeric material by way of example and not limitation. As can be seen below, the design shape of a preferred embodiment can be thought of as symmetrical or mirrored.

Alternatively, the two cover sections may be of the same material as the central section, but may be cut into separate pieces that are directly attached (e.g. sewn or glued) and/or indirectly attached by for example and not limitation, rigid material such as hard plastic or acrylic or flexible material such as elastic strap(s), rubber and/or stretchy fabric, all of the foregoing being by way of example with other materials still being possible by those skilled in the art and in keeping with the objectives of the present invention.

In further alternatives, the two cover sections may be of differing material from the central section and coupled and/or joined either by direct attachment such as sewing and/or gluing or indirect attachment such as by rigid material again such as hard plastic or acrylic or by flexible material again such as elastic strap(s), rubber and/or stretchy fabric, again all of the foregoing being by way of example with other materials still being possible by those skilled in the art and in keeping with the objectives of the present invention.

In any of the embodiments herein as appropriate, the central portion may be of a flexible cloth fabric and/or an elastic material such as neoprene, nylon or soft polymeric material. Alternatively, the central portion may be of a rigid material such as a plastic, metal, acrylic, or hard polymer.

As alluded to above, the two cover sections may themselves be comprised of differing material, for example, for the purpose of different flexibilities, intending that a more flexible material cover a larger end of the cylinder or telescopic sight vis a vis a possible smaller end of the sight. However, if the cover sections are of the same material, preferably materials may be those that are soft and flexible, such as neoprene, nylon, leather or soft polymeric substitute or hard and rigid material such as a plastic, metal, acrylic, ceramic or polymeric substitute, again all of the foregoing being by way of example with other materials still being possible by those skilled in the art and in keeping with the objectives of the present invention. Here again, and generally speaking with respect to all the embodiments, the covering sections may be of different sizes, such that one end is larger in relation to the other, to better fit differing size ends of the cylinder (e.g. a larger objective lens of a telescopic sight).

Generally speaking, the cover section that couples the two cover sections together may be defined geometrically as "linear" and may be a strap, band, or multiples of the like, composed of a stretchy and flexible material, such as a rubber, elastomeric polymer, leather, or soft fabric. As viewed in the figures, the width of material may be seen to take the shape of a spline or curve, which may be seen generally in the shape of "S" shape. In this way, the "S" shape may be configured so that the extensions of the end piece cover members overlap, and cover the center region of the cylindrical (i.e. telescopic sight) element. Moreover, the central portion may be defined geometrically by a system of one or more fixed angles joining one or more linear segments, for the purpose of joining the two cover sections, where the angles can either be of equal or unequal magnitude or the linear segments can either be of equal or unequal magnitude.

As but another feature, fasteners configured to eliminate the gap formed between the two cover sections when wrapped around the cylindrical body may be provided in the form of one or more snaps, buttons, clasps, buckles, magnets, hook and receptacle or of Velcro (i.e. hook and pile), although here again all of the foregoing being by way of example and not limitation as should be understood by those skilled in the art and in keeping with the objectives of the present invention.

To be clear, and as disclosed herein and recited in the claims, the two cover sections and the central portion need not be of one unitary piece of material. That is, the two sections may be coupled together with one or more adjustable elements, such that when wrapped around, underneath or over a coaxial member, which is in the preferred embodiment a gun shaft, the two covering sections are preferably held under tension and cover at least the ends of the cylindrical element. In preferred embodiments, the one or more adjustable elements may be a strap made of (e.g.) leather, an elastic band or elastic strap, a drawstring, a cord and/or a soft and flexible fabric.

It should also be understood that the present invention and the preferred embodiments disclosed herein contemplate that the covering device could be directly (i.e. without the gun shaft) wrapped around, underneath or over the cylindrical (i.e. telescopic sight) element.

Furthermore, and as also contemplated, when wrapped around, underneath or over the cylindrical (i.e. telescopic sight) element, the central section may completely cover the cylindrical element, may significantly cover the cylindrical element, not significantly cover the cylindrical element, such that the end portions of the cylindrical element are the only sections that are significantly covered and/or is comprised of multiple elements to increase coverage of the cylindrical element.

Other features are also contemplated herein, such as flaps for the lenses, wherein the cover sections are each configured with a flap, hinged cover or some member of similar construction that can be flipped up, slid off, or detached therefrom, allowing for access to the ends of the cylindrical element while the cover element is affixed to it. As but one advantage provided thereby, the present invention could thus be maintained on the telescopic sight as contemplated herein as the flaps could be use used to permit the flipping up of the ends to allow for sight through the lenses.

In another advantageous feature, a strap for a cover suspension may be provided, where there is a strap, band, cord, or other element of similar function affixed to the cover element for the purpose of holding the cover element in suspension when disengaged from the cylindrical element. For example, the strap, band, cord or the like may be made of a stretchy and/or flexible material to sufficiently expand and accommodate various coaxial offsets. Moreover, the strap, band, cord or the like may contain hooks, cords, loops, buckles or other elements of similar function, for the purpose of attaching/detaching the strap/cord to the cover element.

With the above in mind, reference is now made specifically to the figures in connection with the following disclosure.

For example, in a first embodiment of the present invention, covering device 10 comprises a first pocket 12 having an opening 14 and a coverable end 16 (FIG. 1 shows end 16 prior to stitching closed for purposes of illustrating its construction and that of the other pocket as well) and a second pocket 18 having an opening 20 and a coverable end 22. As illustrated, it can be readily seen that the first pocket 12 is (i) coupled to the second pocket 18 by an intermediate member 30, (ii) is oriented non-linearly relative to the second pocket 18, which is intended to mean that the pockets are not lined up with each other but rather that the axis lines thereof (respectively identified as axis "A" and axis "B" are not aligned linearly), and (iii) is facing in at least a substantially opposite direction as the second pocket, which is intended to mean that the openings of the respective pockets face each other as illustrated in FIG. 1, i.e. opening 14 faces to the right in FIG. 1 while opening 20 faces to the left. The phrase "at least a substantially" is used to convey that a slight offset of the directions of the pockets would still fall within the scope of the claims, especially when a flexible and/or stretchy materials is used.

Figure 2:
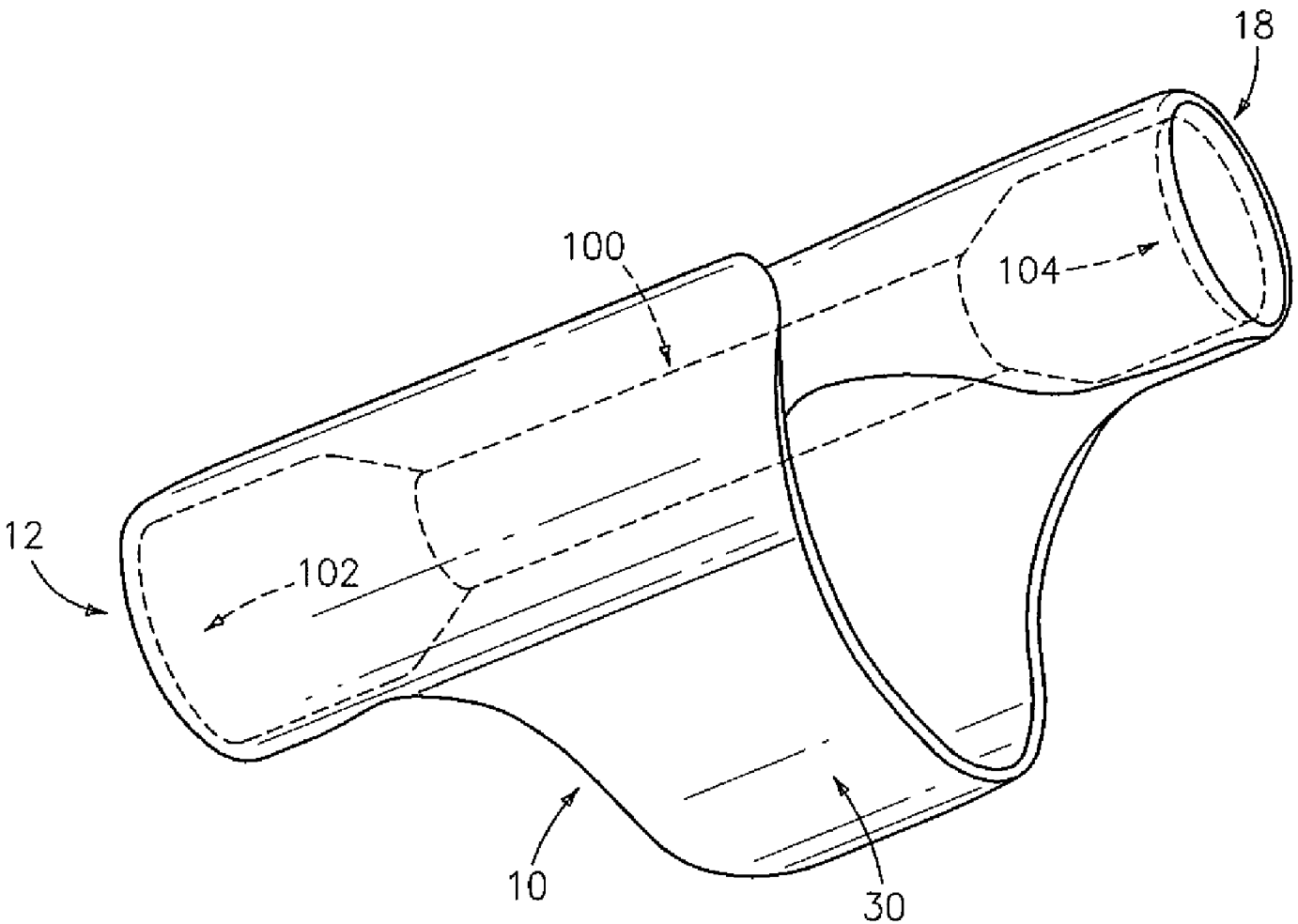
FIG. 2 is a perspective view of the covering device of FIG. 1 shown covering a conventional telescopic sight.

In this way and as illustrated in FIG. 2, the first pocket 12 is coverable upon the first end 102 of the telescopic sight generally indicated at 100, the intermediate member 30 is wrappable around, underneath or over at least a portion of the telescopic sight 100 and the second pocket 18 is coverable upon the second end 104 of the telescopic sight 100.

Figure 3:
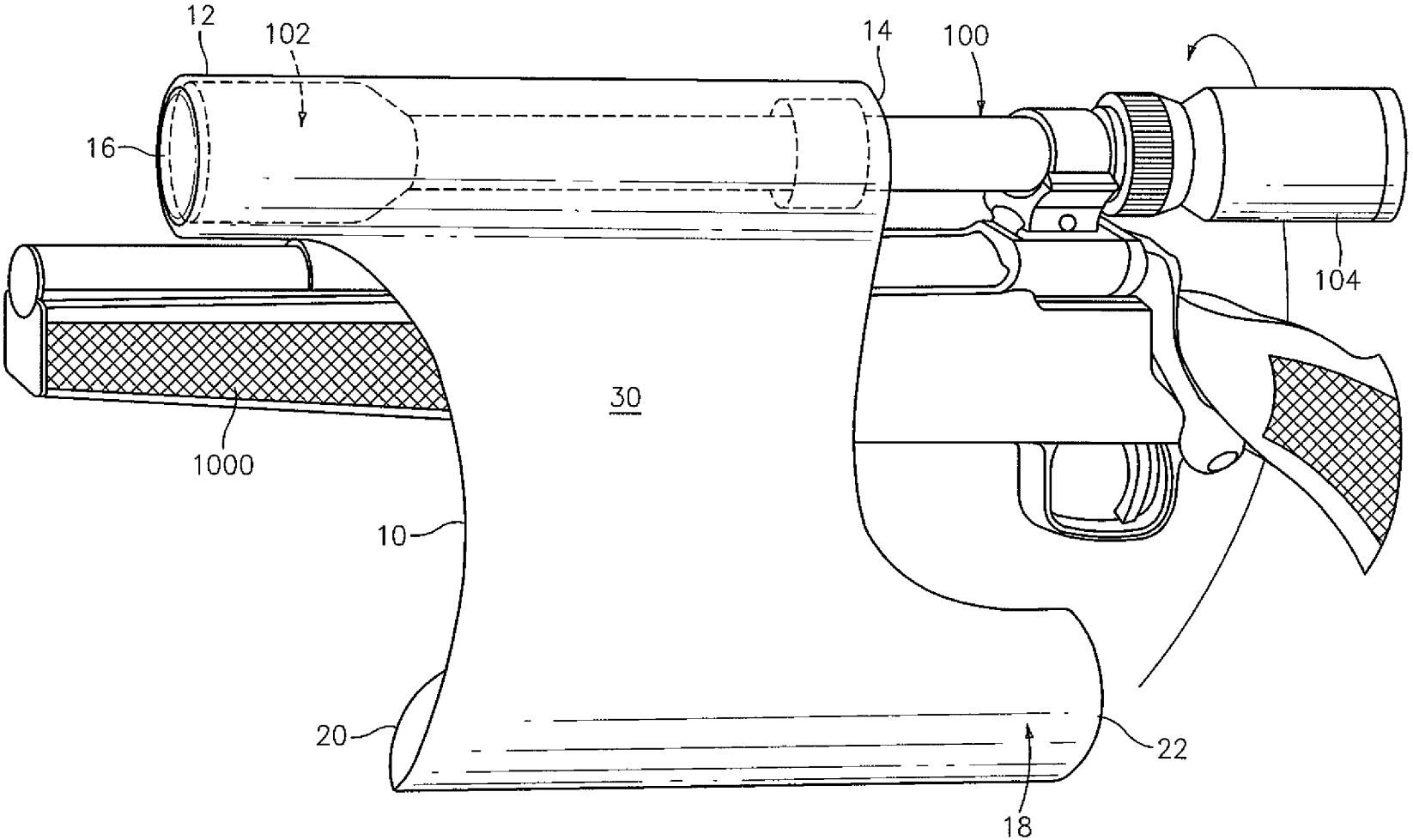
FIG. 3 is a perspective view of the covering device of FIG. 1 as it is covering a telescopic sight, which itself is mounted on a gun shaft.
Figure 4:
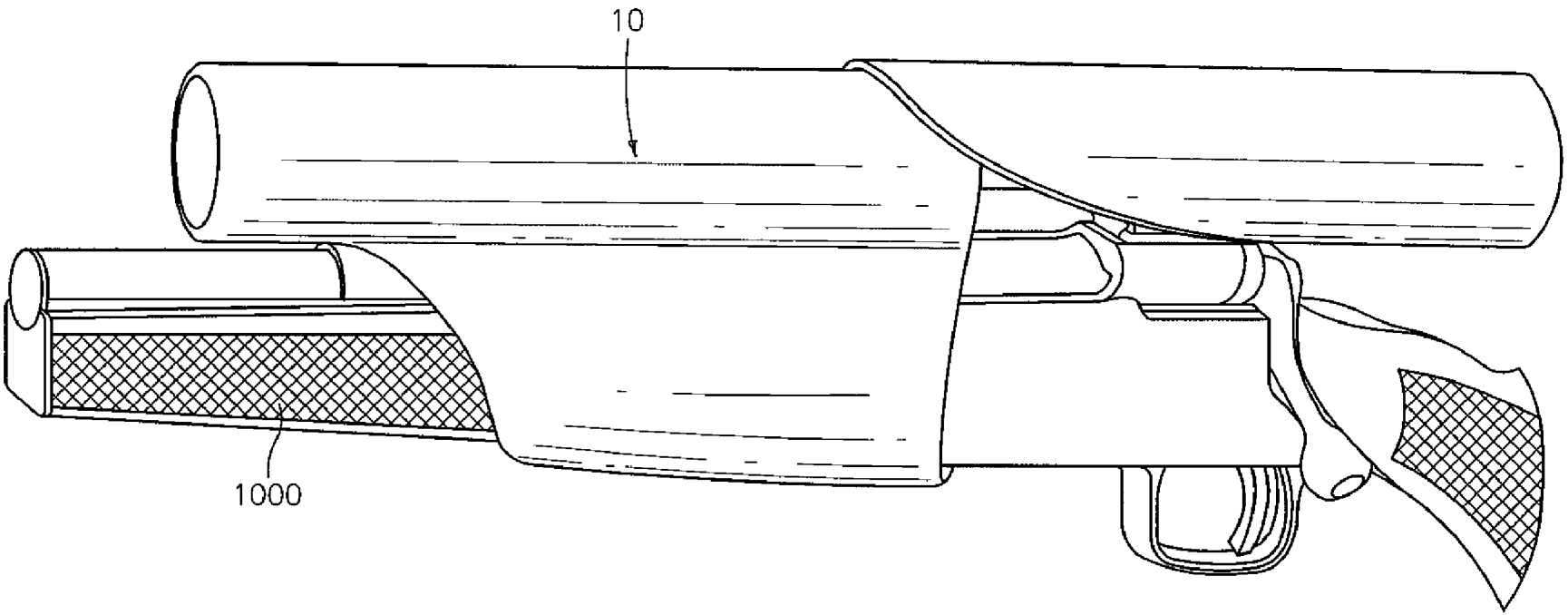
FIG. 4 is a perspective view of the covering device of FIG. 1 covering the telescopic sight on the gun shaft.
Figure 5:
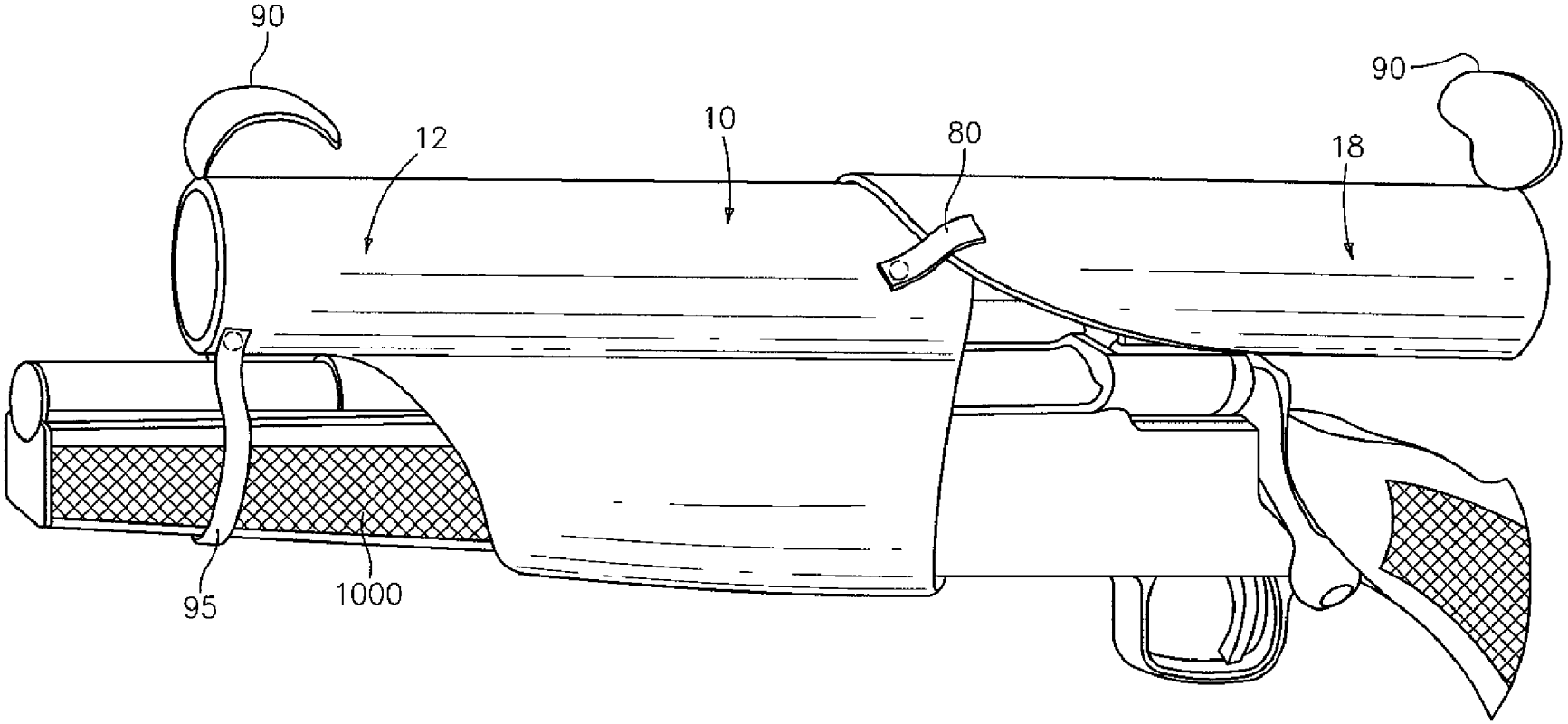
FIG. 5 is a perspective view of a covering device in accordance with the present invention covering a telescopic sight on the gun shaft and particularly illustrating other features and advantages of the present invention.

To be sure, the covering device of the preferred embodiments herein may also be used to cover the elongated telescopic sight 100 when mounted on a gun shaft 1000. Here, the term "shaft" is intended to cover the elongated section of the gun, thus encompassing the term "barrel" or the like. In this preferred embodiment, the covering device 10 is also constructed as disclosed above. However, in use and as illustrated in FIGS. 3-5, the first pocket 12 is coverable upon the first end 102 of the telescopic sight 100, the intermediate member 30 is wrappable around, underneath or over at least a portion of the gun shaft 1000 and the second pocket 18 is coverable upon the second end 104 of the telescopic sight.

To this end, the present invention also contemplates and thus discloses herein a method of covering the ends 102, 104 of an elongated telescopic sight 100 that is mounted on a gun shaft 1000, wherein the elongated telescopic sight has a first end 102 and a second end 104, wherein the covering device 10 comprises a first pocket 12 having an opening 14 and a coverable end 16 and a second pocket 18 having an opening 20 and a coverable end 22, wherein the first pocket 12 is (i) coupled to the second pocket 18 by an intermediate member 30, (ii) oriented non-linearly relative to the second pocket as defined above, and (iii) is facing in at least a substantially opposite direction as the second pocket 18 as disclosed above. In a preferred embodiment, the methodology comprises the steps of covering the first end 102 of the telescopic sight 100 with the first pocket 12; wrapping the intermediate member 30 around at least a portion of the gun shaft 1000; and covering the second end 104 of the telescopic sight 100 with the second pocket 18.

As thus can be seen, covering device 10 for covering at least the ends of a telescopic sight mountable on a gun shaft, preferably comprises in at least one preferred embodiment two opposing cover sections (i.e. pockets 12, 18) that fit over and around the ends of the telescopic sight, where the two sections are coupled by an intermediate member configured such that the two end sections are offset from each other and when wrapped around, underneath or over a portion of the gun shaft, the opposing cover sections are preferably held under tension.

In a preferred embodiment and as illustrated in FIGS. 1-5, the two cover sections 12, 18 and the intermediate member 30 that couples the two sections 12, 18 comprise a single unit, made of the same material (i.e. the covering device is of a unitary piece of material). To be clear however, intermediate member may a separate member selected from the group consisting of a strap, an elastic band, a drawstring, a cord or fabric which is then coupled or connected to the covering sections 12, 18 in one or more of the manners disclosed herein.

However, it should be clear that while the two cover sections 12, 18 and the intermediate member 30 may be of the same material, they may be coupled together by at least one of stitching and glue. Alternatively, the two cover sections 12, 18 and the intermediate member 30 may be indirectly connected by at least one of a rigid material or flexible material.

Still further, the two cover sections 12, 18 and the intermediate member 30 may be comprised of at least two different materials and/or the two cover sections themselves may be made of a different material.

As further alternative constructions, the intermediate member 30 may be in the form of a strap or a band and is comprised of a stretchable and flexible material.

As also illustrated in FIG. 5, a specific embodiment of the present invention may comprise one or more fasteners 80 for eliminating a gap formable between the two cover sections when wrapped around the gun shaft, wherein the fasteners are selected from the group consisting of a snap, button, clasp, a buckle, a magnet, a hook and receptacle and a hook and pile.

Lastly, and as alluded to above and shown in FIG. 1, the present invention can be used to simply and effectively cover the telescopic sight 100, even when not on the gun shaft. In such a situation, it should be clear that covering device 10 may simply be wrapped around, underneath or over a portion of the telescopic sight as disclosed here such that the opposing cover sections 12, 18 are preferably held under tension.

As but yet another advantage of the present invention, the covering device 10 may be made of a water-resistant and/or waterproof material.

Still further, and as additional features of the present invention and shown in FIG. 5, flaps 90 for the lenses may be provided wherein the two pockets 12, 18 are configured with a flap, hinged cover or some member of similar construction, that can be flipped up, slid off, or detached therefrom, allowing for access to the ends of the cylindrical element while the cover element is affixed to it. In this way, one can use the gun/scope assembly with covering device 10 still attached, while just flipping up the end pieces to allow for sight through the lenses.

Additionally and as shown in FIG. 5, a strap 95 for cover suspension may be provided, where there is a strap, band, cord, or other element of similar function affixed to the cover element for the purpose of holding the cover element in suspension when disengaged from the cylindrical element. Preferably, the strap/cord is made of a stretchy, flexible material, to sufficiently expand and accommodate various coaxial offsets. The strap/cord may contain hooks, cords, loops, buckles or other elements of similar function, for the purpose of attaching/detaching the strap/cord to the cover element.

Figure 6:
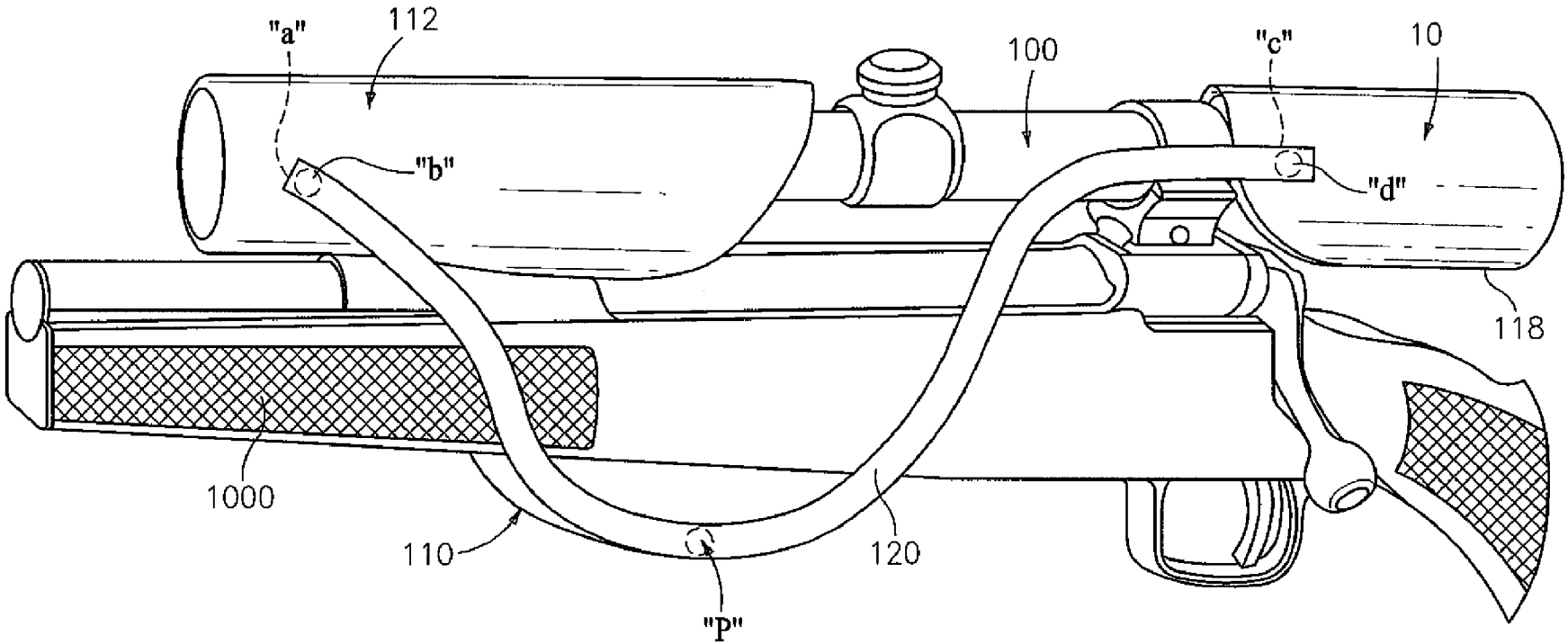
FIG. 6 is a perspective view of a covering device constructed in accordance with another preferred embodiment, and illustrated covering a conventional telescopic sight, which itself is mounted on a gun shaft.

Reference is also now made to FIG. 6 in connection with yet another preferred embodiment, wherein the covering device is preferably for an elongated telescopic sight that is mounted on a gun shaft, and the elongated telescopic sight has a first end and a second end. In this embodiment, the covering device comprises a first pocket having an opening and a coverable end and a second pocket having an opening and a coverable end, wherein the first pocket is coupled to the second pocket by a intermediate arrangement; wherein the intermediate arrangement is dimensioned to permit the gun shaft to extend therethrough; and wherein when the first pocket is coverable upon the first end of the telescopic sight and the second pocket is coverable upon the second end of the telescopic sight the gun shaft is intermediate the telescopic sight and at least a part of the intermediate arrangement and, the intermediate member extends under the gun shaft. As illustrated in FIG. 6, the intermediate arrangement is configured such that it engages, interlocks, or holds underneath, around, or over at least a portion of the gun shaft and mounted telescopic sight. For example, the intermediate arrangement of this embodiment could be two cords 110, 120 coupled to respective sides of the pockets 112, 118 as illustrated in FIG. 6 and coupled together at a point "P" below the gun shaft, the intermediate arrangement could be one piece of fabric, or one or more sections of fabric. The novelty lies in the ability of the covering device to remain coupled to the gun shaft even when/if the pockets are disconnected from the ends of the telescopic sight. Preferably in this embodiment, it is envisioned that the covering device could be removed from the gun shaft by decoupling cords 110, 120 that may be coupled together at point "P" by means of for example and not limitation, snaps, buttons, clasps, buckles, magnets, a hook and receptacle and/or a hook and pile arrangement. Alternatively, the cords or other forms of intermediate arrangement could be coupled (e.g. via snaps, buttons, clasps, buckles, magnets, a hook and receptacle and/or a hook and pile arrangement) to the respective pockets 112, 118 in the positions denoted by letters "a," "b," "c" and "d" illustrated in FIG. 6 for easier disconnection of the device 10' to the gun shaft.

Figure 7:
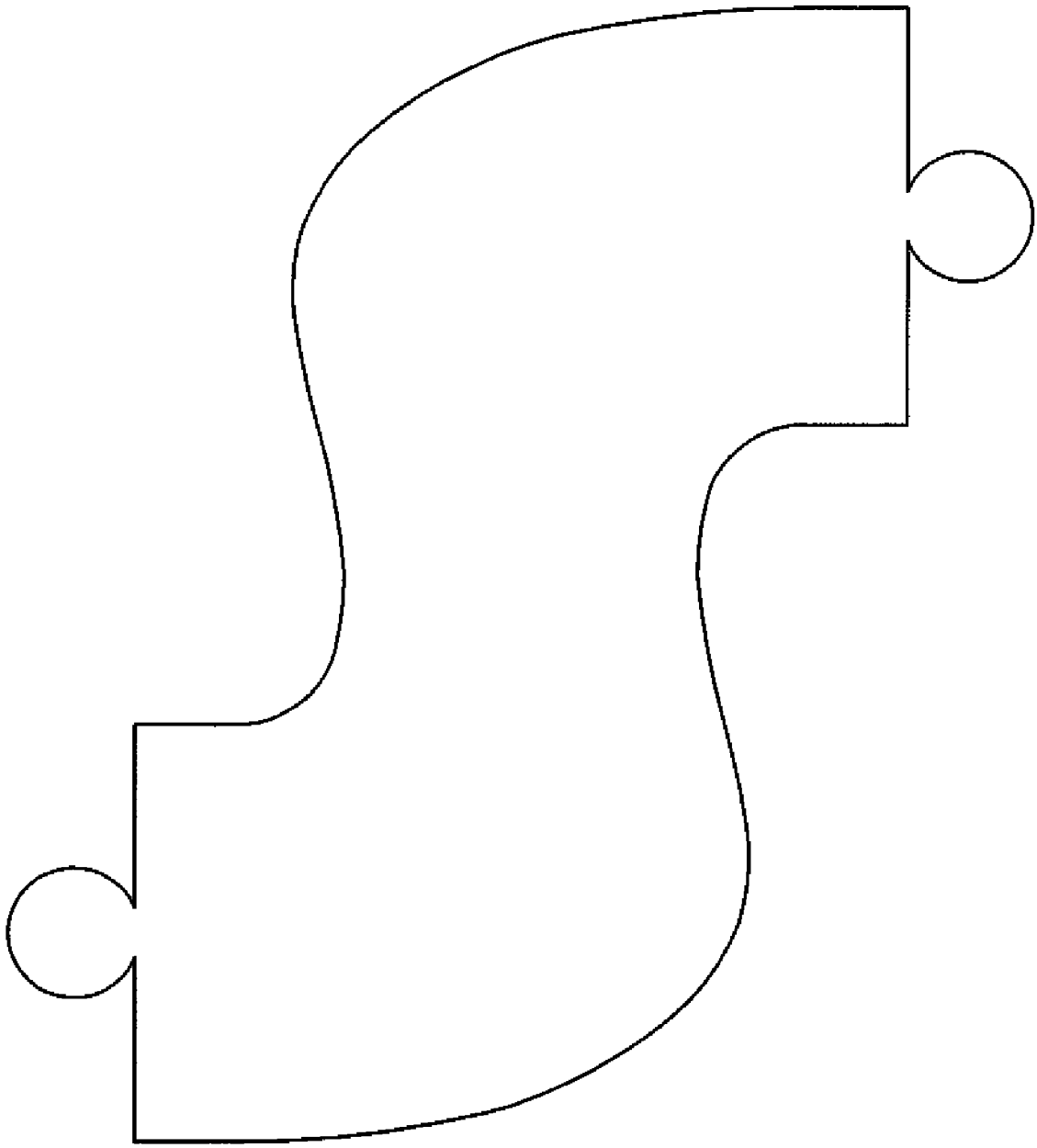
FIG. 7 is a plan view of the covering device prior to construction, showing exemplary dimensions for a preferred construction in accordance with the preferred embodiments of the present invention.

Lastly, FIG. 7 is a plan view of the covering device 10 prior to construction, showing exemplary dimensions in inches for a preferred construction in accordance with the preferred embodiments of the present invention. However, this should be construed for purposes of illustration and not limitation as other sizes and dimensions are clearly within the scope of the invention as alluded to herein. Stitching and/or gluing the material in the form of the remaining figures should be well understood by those skilled in the art in view of the remaining disclosure herein.

Importantly, it should be understood that the fact that the reference numerals used herein may capture or otherwise point to various and/or more than one element in the figures should not be interpreted in a limiting sense. That is, it is intended that the claims cover the inventive aspects and features of the present invention, but with a recognition that a particular feature or element although otherwise disclosed or indicated by reference numeral in the figures, need not be read into the claims.

It can thus be seen that the present invention is advantageous and overcomes the perceived deficiencies in the prior art. For example, the present invention discloses an improved cover device for a telescopic sight that is less complicated, less expensive to manufacture, easier to use, and just generally more desirable and versatile than prior art constructions.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall there between.

What is claimed is:

1. A covering device for an elongated telescopic sight that is mounted on a gun shaft, wherein the elongated telescopic sight has a first end and a second end, the covering device comprising:

a first pocket having an opening and a coverable end, a second pocket having an opening and a coverable end, and an intermediate member connecting the first and second pockets, which is an S-shaped cut of fabric in an open and expanded layout;

wherein the covering device is shaped to permit: first covering the first end of the telescopic sight with the coverable end of the first pocket, and thereafter wrapping the S-shaped intermediate member around, underneath and over at least a portion of the gun shaft; and thereafter covering the second end of the telescopic sight with the coverable end of the second pocket.

2. The covering device as claimed in claim 1, wherein the two cover sections and the intermediate member that couples them comprise a single unit, made of the same material.

3. The covering device as claimed in claim 1, wherein the two cover sections and the intermediate member that couples them are of the same material and coupled together by at least one of stitching and glue.

4. The covering device as claimed in claim 1, wherein the two cover sections and the intermediate member that couples them are indirectly connected by at least one of a rigid material or flexible material.

5. The covering device as claimed in claim 1, wherein the two cover sections and the intermediate member that couples them are comprised of at least two different materials.

6. The covering device as claimed in claim 5, wherein the two cover sections are comprised of a different material.

7. The covering device as claimed in claim 1, wherein at least one of the first and second pockets include means for allowing access to the respective end of the telescopic sight, while the covering device is mounted on both the first end and the second end of the telescopic sight.

8. The covering device as claimed in claim 7, wherein the means for allowing access to the respective end of the telescopic sight is a flap, a removable cover or a hinged cover.

9. The covering device as claimed in claim 1, wherein the covering device does not have any attachment means between the covering device and the intermediary portion of the telescopic sight of a gun.

10. The covering device as claimed in claim 1, wherein the covering device does not require any fasteners to hold the covering device in place on the telescopic sight of a gun.

11. The covering device as claimed in claim 1, wherein the covering device is held in place on the telescopic sight due to the tension between the first pocket and the second pocket.

12. The covering device as claimed in claim 1, wherein the covering device is shaped to permit: first covering the first end of the telescopic sight with the first pocket, and thereafter wrapping the intermediate member in a helical manner over at least a portion of the gun shaft; and thereafter covering the second end of the telescopic sight with the second pocket.

13. The covering device as claimed in claim 1, wherein the covering device is shaped so that in an opened layout, the first pocket is oriented non-linearly relative to the second pocket, and in a mounted position wherein the covering device is covering the first end of the telescopic sight, wrapped around, underneath or over at least a portion of the gun shaft and covering the second end of the telescopic sight, the first pocket is oriented linearly relative to the second pocket.

14. The covering device as claimed in claim 1, wherein the coverable ends of the first pocket and the second pocket fully covers each respective end of the telescopic sight.

15. The covering device as claimed in claim 14, wherein the coverable ends of the first and second pocket and the intermediate member that couples them are of the same material and coupled together by at least one of stitching and glue.

16. A covering device for an elongated telescopic sight having a first end and a second end, the covering device comprising:

a first pocket having an opening and a coverable end, a second pocket having an opening and a coverable end, and an intermediate member connecting the first and second pockets, which is an S-shaped cut of fabric in an open and expanded layout;

wherein the covering device is shaped to permit: first covering the first end of the telescopic sight with the coverable end of the first pocket, and thereafter wrapping the S-shaped intermediate member around, underneath and over at least a portion of the gun shaft; and thereafter covering the second end of the telescopic sight with the coverable end of the second pocket.

17. A method of covering the ends of an elongated telescopic sight that is mounted on a gun shaft, wherein the elongated telescopic sight has a first end and a second end, wherein the covering device comprises a first pocket having an opening and a coverable end, a second pocket having an opening and a coverable end, and an intermediate member connecting the first and second pockets, which is an S-shaped cut of fabric in an open and expanded layout; wherein the method comprises the steps of:

first covering the first end of the telescopic sight with the coverable end of the first pocket;

and thereafter wrapping the S-shaped intermediate member around, underneath and over at least a portion of the gun shaft; and thereafter covering the second end of the telescopic sight with the coverable end of the second pocket.

* * * * *